US006453502B1

(12) United States Patent
Bishop

(10) Patent No.: US 6,453,502 B1
(45) Date of Patent: Sep. 24, 2002

(54) UNIVERSAL CLEANING AND POLISHING PAD

(76) Inventor: DeForest Bishop, 1431, Dalton, GA (US) 30720

( * ) Notice: Subject to any disclaimer, the term of this patent is extended or adjusted under 35 U.S.C. 154(b) by 0 days.

(21) Appl. No.: 09/452,199

(22) Filed: Dec. 2, 1999

Related U.S. Application Data

(60) Provisional application No. 60/113,535, filed on Dec. 22, 1998.

(51) Int. Cl.[7] ..... A47L 13/12; A47L 13/28

(52) U.S. Cl. ..... 15/118; 15/208; 15/209.1; 428/92

(58) Field of Search ..... 15/118, 208, 209.1, 15/226, 229.1, 230, 230.12; 428/92

(56) References Cited

U.S. PATENT DOCUMENTS

| | | | | |
|---|---|---|---|---|
| 2,332,936 | A | * | 10/1943 | Schlegel |
| 3,638,270 | A | | 2/1972 | Schlegel, Jr. et al. |
| 3,856,596 | A | | 12/1974 | Shorrock |
| 3,900,624 | A | | 8/1975 | Schare |
| 4,159,883 | A | | 7/1979 | Mizell |
| 4,244,074 | A | * | 1/1981 | Barcikowski |
| 4,323,612 | A | | 4/1982 | van Issum |
| 4,617,208 | A | * | 10/1986 | Cadenhead, Sr. |
| 4,645,699 | A | | 2/1987 | Neveu |
| 4,820,566 | A | | 4/1989 | Heine et al. |
| 5,134,746 | A | | 8/1992 | William |
| 5,612,113 | A | | 3/1997 | Irwin, Sr. |
| 5,814,388 | A | | 9/1998 | Fryan |
| 5,906,877 | A | | 5/1999 | Popper et al. |
| 5,945,215 | A | | 8/1999 | Bersted et al. |

* cited by examiner

*Primary Examiner*—Randall E. Chin
(74) *Attorney, Agent, or Firm*—Miles & Stockbridge P.C.

(57) ABSTRACT

A cleaning and polishing pad including densely packed fibrillated face yarns on one side and an opposite polishing side, which alternatively may be a resilient, textured surface, or an open-celled sponge. The pad is constructed of all synthetic materials using conventional carpet manufacturing techniques. Synthetic fibrillated face yarns are tufted into a primary back which may be a woven polypropylene product, scrim, sponge or other sheet material. The face yarns include yarns of at least two (2) deniers, tightly packed, to provide both a soft and hard bristle face with the yarns cooperating to produce a non-abrasive scrubbing pad. Optionally, a secondary synthetic substrate, such as, for example, a latex substrate, applied to the backside of the tufted product provides a secondary back and a means of locking the yarns into place in the primary backing. Either the secondary back or a separate polishing substrate adhered to the secondary back also forms a polishing or non-abrasive cleaning surface. In a second configuration, the non-abrasive surface is a solution-absorbent, sponge-like material adhesively attached to the backside of the primary back of the tufted product. The latex and/or secondary back or secondary latex back or the sponge-like material gives the pad dimensional stability and shape memory, while allowing it to be bent and crushed during cleaning.

17 Claims, 4 Drawing Sheets

UNIVERSAL CLEANING AND POLISHING PAD

CROSS-REFERENCE TO RELATED PATENTS

This application claims the benefit of U.S. Provisional Application No. 60/113,535, filed Dec. 22, 1998.

FIELD OF THE INVENTION

The present invention relates to cleaning implements and, more particularly, to a two-sided cleaning and polishing pad having a non-absorbent scrubbing face of different density, closely packed yarns on one side for heavy duty work and a soft embossed and absorbent surface on the other side for light-weight work.

BACKGROUND OF THE INVENTION

Various types of hand-held cleaning implements are utilized in households for cleaning items such as dishes, pots, pans, glassware, windows, furniture, toys, cars and the like. Such products generally have surfaces which are readily subject to scratching from cleaning implements and cleaning materials and frequently resort is made to different types of cleaning materials and implements for each type of product. For example, glassware and dishes are generally cleaned with a soft soap and sponge. Pots and pans, on the other hand, which are exposed to heat during cooking and which tend to have food particles encrusted thereon, require an abrasive cleaner and an abrasive type cleaning implement, such as, for example, a "soft" steel wool pad or a non-woven stiff open mesh. Cars and toys which are exposed to the elements often require a hard scrubbing action to get them clean, but care must be taken not to use abrasives that might scratch the finish. Abrasive cleaners and implements should likewise not be used on soft finishes. Cleaning pads useful for scrubbing encrusted articles from pots and pans generally should not be used on surfaces coated with Teflon. On the other hand, pads used for delicate surfaces or light-weight cleaning are not necessarily satisfactory for heavy duty work. Thus, there is a need for a universal cleaning and polishing pad, adapted for use for a variety of applications and which can be economically manufactured. The present invention meets these needs.

RELATED ART

U.S. Pat. No. 5,348,785 describes a manufacturing process for making carpet having a primary and secondary backing. Pile yarns are tufted into the primary backing fabric, after which a thin layer of latex is applied to the underside of the primary backing fabric to lock the tufts in place and to provide an adhesive for the secondary backing material.

U.S. Pat. No. 3,542,632 discloses a process for making fibrillated fabrics, including a process for tufting pile fabrics which employ the fibrillated, woven synthetic fabrics as a primary and secondary backing. U.S. Pat. No. 3,110,905 describes a method for manufacturing from relatively flat yarns, a backing material for tufted pile fabric.

U.S. Pat. No. 5,311,635 describes a cleaning pad configured to be mounted on a shower wall, the pad including a sponge rubber portion covered with carpet material. The carpet material is the only exposed cleaning surface.

U.S. Pat. No. 5,035,468 discloses a scrub brush comprising a sponge portion affixed to one side of a rigid backing and a plurality of single denier bristles affixed to the opposite side of the rigid backing.

SUMMARY OF THE INVENTION

The universal cleaning and polishing pad of the present invention includes densely packed fibrillated face yarns on one side and an opposite polishing side, which alternatively may be a resilient, textured surface, or an open-celled sponge. The pad is constructed of all synthetic materials using conventional carpet manufacturing techniques. Synthetic fibrillated face yarns are tufted into a primary back which may be a woven polypropylene product, scrim, sponge or other sheet material. The face yarns include yarns of at least two (2), deniers, tightly packed, to provide both a soft and hard bristle face with the yarns cooperating to produce a non-abrasive scrubbing pad. Optionally, a secondary synthetic substrate, such as, for example, a latex substrate, applied to the backside of the tufted product provides a secondary back and a means of locking the yarns into place in the primary backing. Either the secondary back or a separate polishing substrate adhered to the secondary back also forms a polishing or non-abrasive cleaning surface. In a second configuration, the non-abrasive surface is a solution-absorbent, sponge-like material adhesively attached to the backside of the tufted product. The latex and/or secondary back or secondary latex back or the sponge-like material gives the pad dimensional stability and shape memory, while allowing it to be bent and crushed during cleaning.

BRIEF DESCRIPTION OF THE DRAWINGS

The above and other features of the present invention and the attendant advantages will be readily apparent to those having ordinary skill in the art and the invention will be more easily understood from the following detailed description of the preferred embodiments of the present invention, taken in conjunction with the accompanying drawing.

DESCRIPTION OF THE PREFERRED EMBODIMENTS

Figure 1:
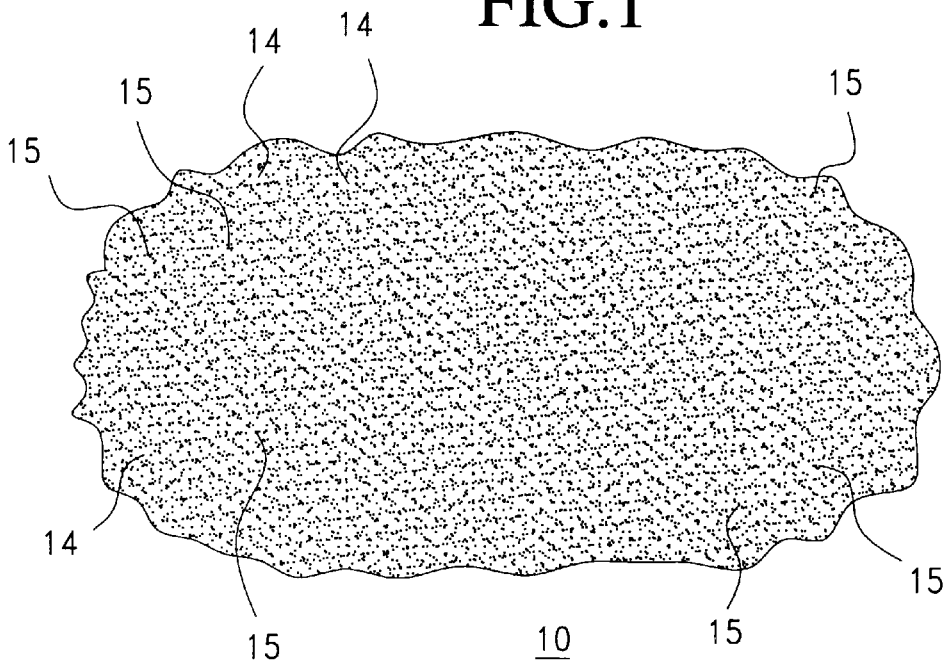
FIG. 1 is a top plan view of a cleaning pad made in accordance with the present invention.

Referring to FIG. 1, there is illustrated the universal cleaning and polishing pad of the present invention which comprises a pad (10) fabricated in accordance with conventional carpet technology techniques. One face (12) of pad (10) comprises densely packed fibrillated yarns (14, 15) which are tufted into a primary back (16), yarns (14,15) are slit, i.e., fibrillated so as to form free ends, as more clearly shown in FIGS. 3 and 4, respectively. The face yarns (14, 15) preferably are fibrillated and include yarns of at least two (2) different deniers. The heavier denier yarns (14) are shown in FIG. 1 in lighter sections and the lighter denier yarns are shown in darker sections and identified with reference character 15. The lighter yarns have a denier between 500 and 1,000, and preferably 600 to 700, and provide a soft rubbing action for cleaning purposes. The heavier, stiffer yarn provide a bristle-like scrubbing action and have a denier between 1,000 and 10,000, and preferably in the range of approximately 6,000 to 7,000. The yarns are densely packed, as shown in FIG. 1, with sufficient weight to provide a pad whose weight is between about 16 and about 60 ounces per square yard, and preferably within the range of about 40 to about 50 ounces per square yard. The lighter yarns permit movement of the heavier, stiffer yarn to enhance the scrubbing action. Optionally, the yarns generally may be of differing lengths and in addition, the yarns of one denier may differ in length with respect to the yarns of another denier.

Figure 2:
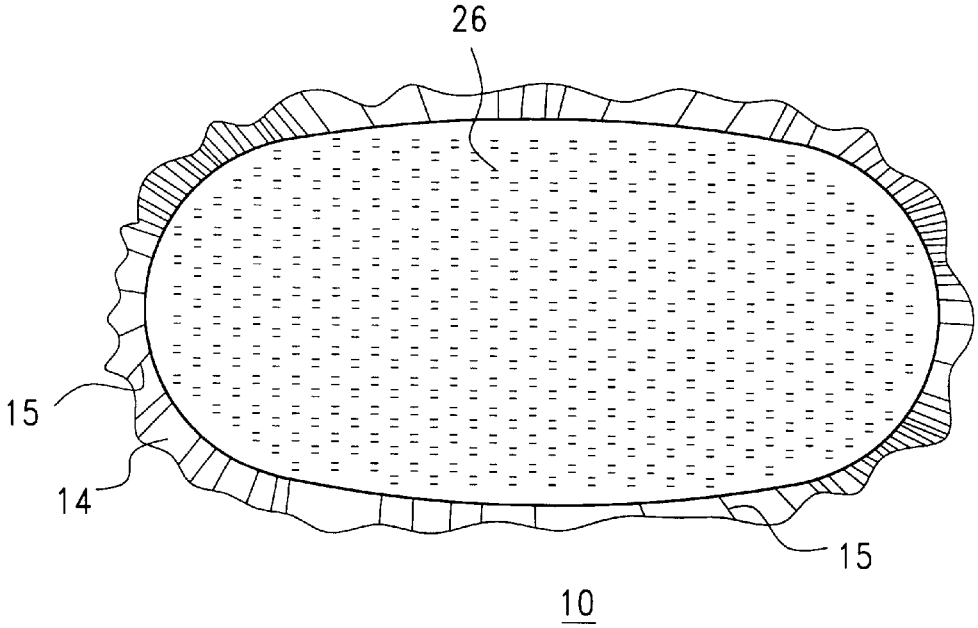
FIG. 2 is a bottom view of the cleaning pad of FIG. 1.

Various non-absorbent polyolefin materials may be used for the face yarn, including nylon, polyethylene, polypropylene, as well as other synthetic yarns. Using conventional carpet fabrication techniques, the yarns are preferably tufted into a primary synthetic back (16). A suitable synthetic substrate for accepting yarns may be used, such as, for example, scrim, needle punch, sponge or other lightweight synthetic web fabric or film. Typically, the primary back may be a woven web of polypropylene ribbon yarns. The yarns are tufted through the primary back (16) and preferably are lock-stitched in place on the back side by a light application or pre-coat of latex adhesive of about 10 to about 25 ounces per square yard. Thereafter, a secondary latex back layer (22) may be applied of approximately 32 ounces per square yard and embossed with a waffle-like pattern (26), as shown in FIG. 2. Other suitable backings may be utilized, such as, for example, polyurethane, sponge, blown polyurethane, etc., to provide a thick surface for grasping or wiping a surface. Advantageously, the secondary backing is selected so as to provide dimensional stability and shape memory to the pad which ensures restoration of the pad to its initial shape after use.

Figure 3:
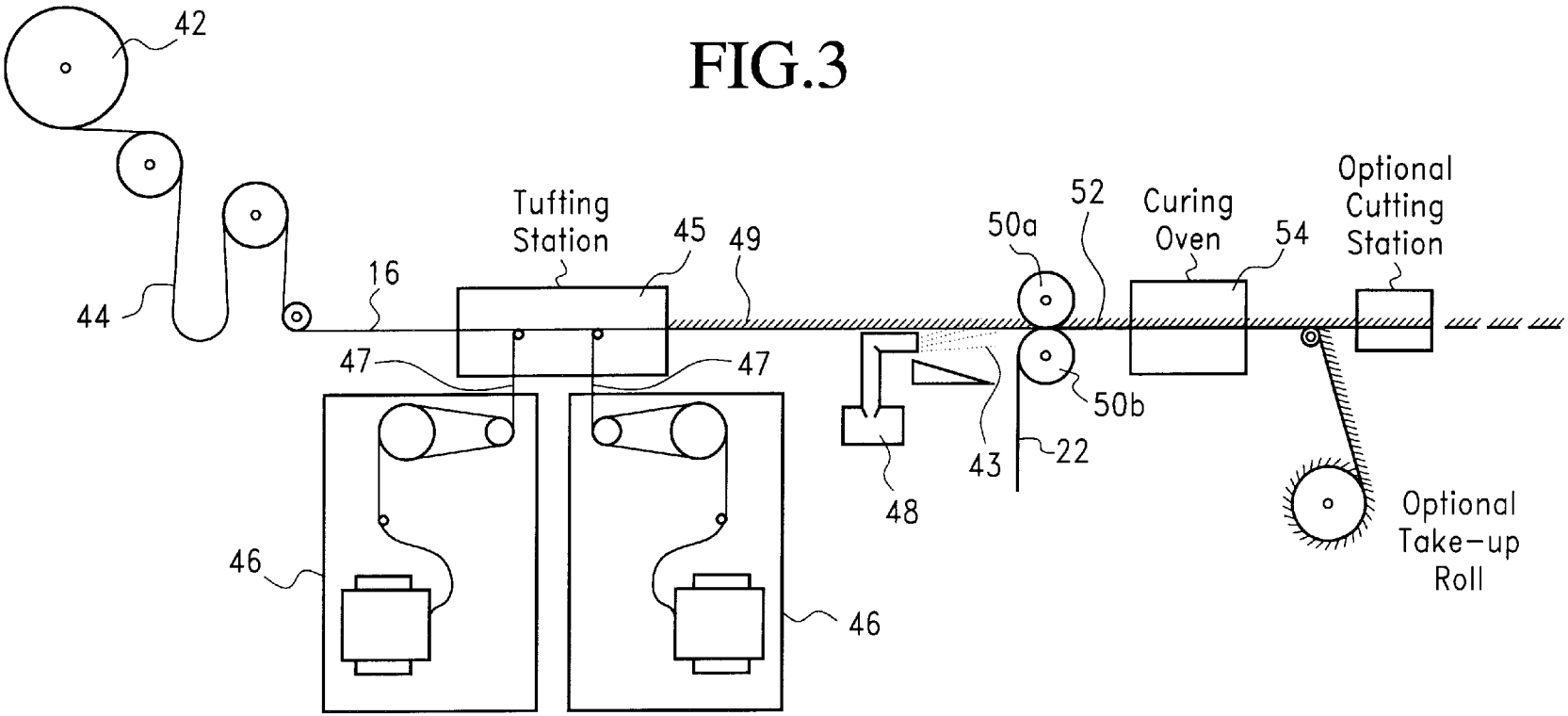
FIG. 3 is a simplified schematic of a manufacturing arrangement according to the present invention.

FIG. 3 is a simplified schematic of a manufacturing arrangement in which a primary back (16), also referred to as a primary substrate (16), is conveyed from an arrangement of supply rollers (42) over a plurality of guide rollers to a feed arrangement (44), such as, for example, a J backup or overload station, which forms a feed to a tufting station (45), all of which are known arrangements and therefore are not described in further detail. The tufting station (45) has supplied thereto from creels (46) a plurality of strands of yarn (47), which are tufted through the primary back (16) according to known methods. Multi-filament yarn (47) is preferably a suitable polyolefin material, such as nylon, polypropylene, or polyethylene. The primary back (16) may be woven ribbon yarn product or a sheet of felt or sponge or an extruded web fabric. The primary back (16) should have a weight of about 25 ounces per square yard and in a preferred embodiment the primary back is a lightweight-spun web.

Optionally, a locking coating (43) such as, for example, latex, may be applied at an application station (48) to the underside of tufted primary back (49) for the purpose of locking the stitches of the tufts in place.

Figure 4:
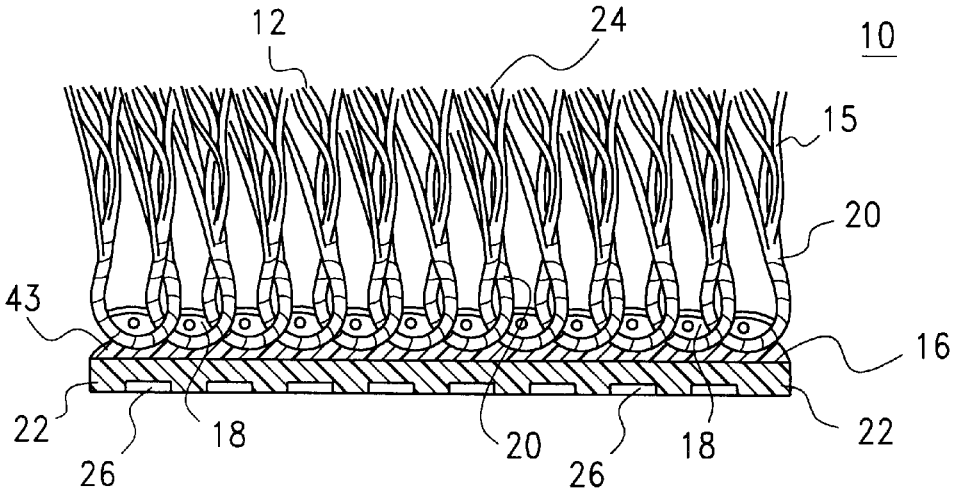
FIG. 4 is a cut-away view of the pad of FIG. 1 illustrating a pad having a tufted construction according to the invention.

FIG. 4 is a schematic sectional view of a portion of the pad (10). The yarns (14 and 15) are tufted through the synthetic backing (16) and lock-stitched in place at (18) by a light application of latex adhesive. The yarns are flat ribbon in form, approximately 5 mils thick and are slit and twisted to form a plurality of thin filaments at their ends (24). The slit yarn is said to be fibrillated. Each strand of yarn comprises from about 20 to 50 or more individual filaments. The upstanding pile face provides a stiff scrubbing surface at the top (24) due to the weight and close compactness of the yarns. The combination of heavy and light denier fibers of the yarn gives flexibility to the yarn as the heavy denier fibers are diluted by the lighter denier fibers, which allow for bending and movement, i.e., although they are relatively closely spaced to each other, yet still, the lighter denier fibers have greater flexibility allowing the heavier fibers to bend or rotate or twist. Advantageously, due to fiber size and weight, the closely compacted combination of multiple denier fibers retains a desired degree of stiffness and ability to withstand scrubbing pressures typically exerted by the user, without crushing. At the same time, this combination of fibers also exhibits a desired degree of softness, which is pleasing to the user and is relatively gentle on the surface being cleaned.

For convenience and clarity of illustration, certain strands (20) are illustrated with darker portions to emphasize the different denier of the yarns used. In the preferred embodiment, the lighter denier yarns are dispersed throughout the surface of the pad and between the heavier denier yarns. This provides more flexibility for the stiffer upstanding yarns, allowing them to more readily bend back and forth to provide an effective cleaning action. If desired, however, by selective needle selection in the tufting machine, yarn patterns can be made. For example, the softer yarn may be colored and stitched so as to form a border along the pad or an internal pattern such as a letter or series of letters which may be particularly desired for promotional or advertising purposes.

Now referring again to FIG. 3, after the tufting step and optional application of a locking coating (43) are complete, a secondary backing or substrate (22) may be applied for the purpose of forming a polishing surface. The tufted primary back and secondary backing (22) are adhered to each other as both backings (49, 22) pass between upper **(50*a*) and lower (50*b*) marriage rolls. An embossed pattern may be applied directly to the back coating (43) to be used as a polishing surface. The combined backings (52) are fed through a curing oven (54) as necessary, depending on the backing materials and adhesive selected. As a final step, the product is fed onto a take-up roll (56) or optionally, to a cutting station (58)**, for reduction to pads of suitable shape and dimension.

A non-aqueous adhesive other than hot melt adhesives may be applied to the primary back. Such adhesives should not contain solvents or water which would require additional processing and difficulties. Polyurethane is one such conventional adhesive known in the bonding art. Others are polyvinylchloride, polyvinyl acetate, epoxies and the like. Such adhesives may be coated conventionally onto the back of the primary backing and cured with or without heat, dependent upon the particular composition of the adhesive. These adhesives may also when applied to the primary backing act as a pre-coat to lock the loose yarns.

Backing (22), which preferably is latex, provides dimensional stability to the pad and includes a soft flexible finish which enables the pad to be conveniently squeezed and bent during use and returned to its original physical shape by virtue of its shape memory. Advantageously, backing (22) may be of varying thickness and is embossed with a pattern (26), such as, for example, a waffle pattern, to provide a slightly roughened surface for enhanced cleaning action where a non-abrasive cleaning implement is required, such as on glassware, dishes, Teflon surfaces, etc. Alternatively, backing (22) may be a soft, open-pored, polyurethane flexible foam compounded to be pliable and to function as a sponge, as described below in connection with FIGS. 6 and 7, useful for cleaning dishes, pots and pans, and flat surfaces.

Other synthetic foamed plastics could be used for the sponge. Such materials are bonded or adhesively secured to the back side of the tufted product with a suitable non-aqueous contact adhesive.

Figure 5:
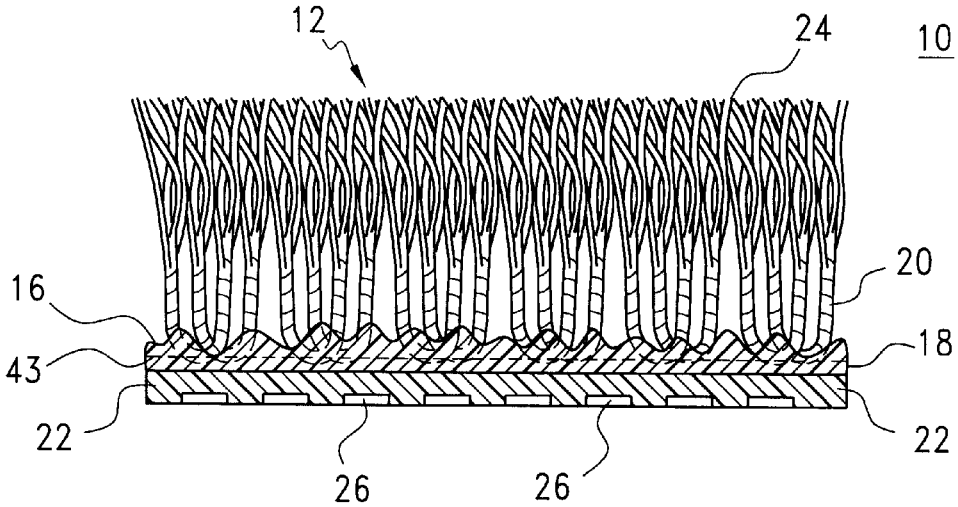
FIG. 5 is a cut-away view of an alternative embodiment of the invention showing a woven construction.

FIG. 5 is similar to that of FIG. 4 and differs only in that the pile or face yarns are depicted as a woven fabric backing through which a plurality of segments of multi-filament yarn (14, 15) has been tufted.

The face of the pad may be a tufted or knitted pile fabric or any other suitable construction. For reasons of cost as well as flexibility of design, a tufted fabric will generally be preferred. The fabric backing may be any suitable woven, felted sponge, scrim or extruded web. A particularly preferred backing is a woven flat ribbon yarn polypropylene fabric having a weight of about twenty-five (25) ounces per square yard. Tufted through the backing are segments of a multi-filament yarn made from about ¼ to about ¾ inch length polyolefin yarn and preferably, from ⅜ inch length polypropylene ribbon about five (5) mils thick, which is slit and twisted to form a plurality of thin filaments. Normally, each strand of yarn will comprise from about 20 to about 50 or more individual filaments. In order to provide a pleasing natural appearance, the yarn is dyed a suitable color.

The density of the tufts may vary depending upon the weight of the multifilament yarn and the intended stiffness of surface desired. For the previously mentioned ⅜ gauge, 5 mil thick polypropylene ribbon yarns, tuft densities ranging from about 8 to about 24 tufts per square inch are useful. This corresponds to stitch rates from about three (3) to about eight (8) stitches per inch on conventional tufting machines which produce 2⅔ rows of tufts per inch. However, the density of tufts should be such as to provide close packing of the upstanding yarns with a weight in the range of about 16 to about 60 ounces per square yard, and preferably about 45 ounces per square yard, with the major portion of the tuft density being attributed to the heavier denier and stiffer yarn. Advantageously, the stiffer yarn will make up at least sixty per cent (60%) by weight of the total weight of the yarn. This distribution will be between 90/10 and 60/40 and preferably about 75/25.

The length of the pile elements may range from about one-fourth (¼) to about one-half (½) inches. In most instances, the pile length will be about three-eight's (⅜) inch.

In accordance with the present invention, the shape and dimensions of the pad are arbitrary, but for ease of handling and use, are generally rectangular or oval, having a length between approximately three (3) to six (6) inches and a cross width between approximately two (2) to four (4) inches. Preferably, the pad is oval in shape with a dimension of about two and one-half (2½) by about five and one-half (5½) inches. For some applications, pads may be made in small square or rectangular sections, readily adapted for packaging. Such pads may be about one by one (1×1) inch or about two by two (2×2) inches and have a preferred application in the kitchen.

Figure 6:
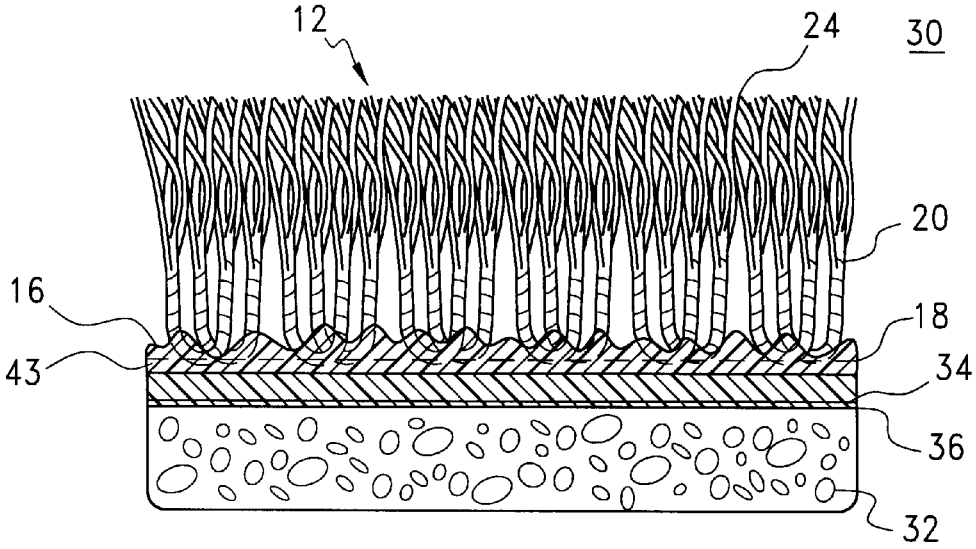
FIG. 6 is a cut-away view of an alternative embodiment of the invention shown in FIG. 4.
Figure 7:
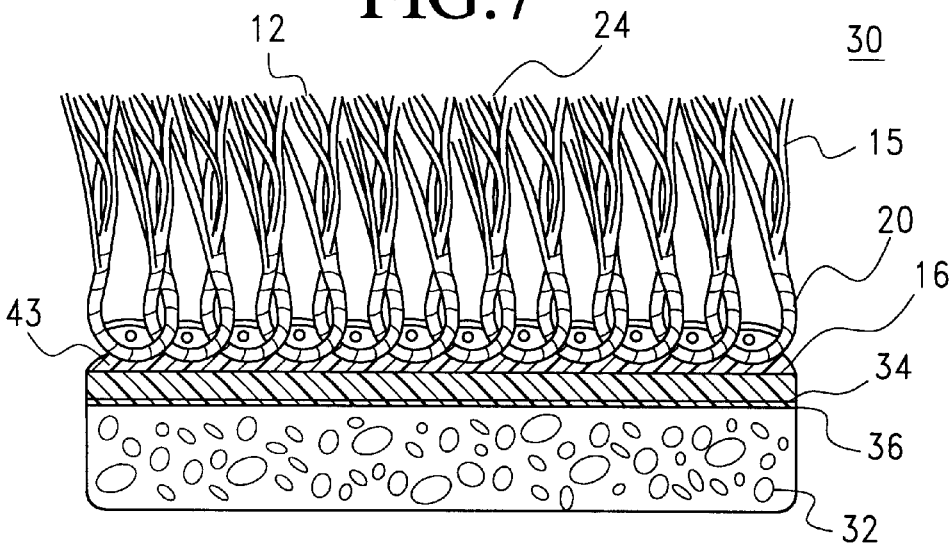
FIG. 7 is a cut-away view of an alternative embodiment of the invention shown in FIG. 5.

FIGS. 6 and 7 are similar to that of FIGS. 4 and 5, respectively, and show a cut-way view of pad (30), which differs from pad (10) only in that the secondary back (22) is an open-cell sponge material (32) attached either directly to primary back (16) or to an intervening coating bob on a side (34) opposite to the exposed strands (14,15). Sponge material (32) preferably is a soft, open-pored, polyurethane flexible foam compounded to be pliable. Other synthetic foamed plastics could be used for the sponge. A suitable contact adhesive is utilized for attachment. The adhesive (36) is applied preferably to the secondary back (22) and the sponge material (32) is placed in contact with the adhesive coating and allowed to set. Alternatively, the adhesive material may be applied to one face of the sponge material (32), and the sponge is then adhesively attached to the primary back (16) or the secondary back (22), as shown in FIGS. 6 and 7.

The foregoing embodiments have been described merely as examples of the invention and are not intended to limit its scope. Since modifications of the described embodiments may occur to persons skilled in the art, the scope of the invention is intended to cover all such modifications with come within the true spirit and full scope of the invention.

What is claimed is:

1. A universal cleaning and polishing pad comprising:

a primary substrate having a first side and a second opposing side;

a plurality of densely packed non-absorbent synthetic fibrillated synthetic yarns of a heavy and light denier tufted to said primary substrate, said heavy denier yarns being at least 60% by weight of the total weight of said yarns, said yarns each including about 20 or more individual extending filaments forming free ends extending outwardly from said first side, said lighter denier yarns permitting flexibility of movement of said heavier denier yarns; and a backing layer being disposed adjacent said second side and having dimensional stability.

2. The pad as recited in claim 1, wherein said plurality of densely packed non-absorbent fibrillated synthetic yarns have a distribution of heavy to light denier in the range of about 90% to 10% by weight.

3. The pad as recited in claim 1, wherein said plurality of densely packed non-absorbent fibrillated synthetic yarns have a distribution of heavy to light denier in the range of about 75% to 25% by weight.

4. The pad as recited in claim 1, wherein said plurality of densely packed non-absorbent fibrillated synthetic yarns are multi-filament polypropylene ribbon yarns about ¼ inch to ¾ inch in length.

5. The pad as recited in claim 1, wherein said plurality of densely packed non-absorbent fibrillated synthetic yarns are multi-filament polypropylene ribbon yarns having a thickness of about five mils and a length of approximately ⅜ inch.

6. The pad as recited in claim 1, wherein said plurality of densely packed non-absorbent fibrillated synthetic yarns have a tuft density of about 8 to about 24 tuffs per square inch.

7. The pad as recited in claim 1, wherein said plurality of densely packed non-absorbent fibrillated synthetic yarns are closely packed, having a packing density in a range of about 16 to about 60 ounces per square yard.

8. The pad as recited in claim 1, wherein said plurality of densely packed non-absorbent fibrillated synthetic yarns have a packing density of about 45 ounces per square yard, with the major position of tuft density being attributed to the heave denier yarns.

9. The pad as recited in claim 1, wherein said plurality of densely packed non-absorbent fibrillated synthetic yarns are a polymer selected from the group comprising nylon, polyethylene and polypropylene.

10. The pad as recited in claim 1, wherein said primary substrate is a woven polypropylene ribbon fabric having a weight of about 25 ounces per square yard.

11. The pad of claim 1 further including a secondary synthetic substrate adhered to said substantially flat surface of said opposite second side of said primary synthetic substrate, said secondary substrate arranged to lock said synthetic face yarns to said primary synthetic substrate and forming a substantially flat polishing and cleaning surface.

12. The pad of claim 1 wherein said polishing substrate is an open-pored, flexible foam sponge.

13. The pad as recited in claim 1, further including a coating between said second side and said backing layer, said coating locking said yarns to said primary substrate on said second side.

14. The pad as recited in claim 1, wherein said backing layer is a substantially flat surface.

15. The pad as recited in claim 1, wherein said backing layer is of a material that has shape memory so as to substantially restore the pad to its initial shape after use.

16. The pad as recited in claim 1, wherein the pad has a length between about 1 to 6 inches and a cross-width between about 1 to 4 inches.

17. The pad as recited in claim 1, wherein the pad has an oval shape with a dimension of about 2½ inches by 5½ inches.

* * * * *